United States Patent [19]

Motoda

[11] 3,965,770

[45] June 29, 1976

[54] ARM MECHANISM FOR MOVING HEAVY MATERIALS IN A TWO-DIMENSIONAL PLANE

[76] Inventor: Kenro Motoda, 9-32-4, Kami-Kitazawa, Setagaya, Tokyo, Japan

[22] Filed: Dec. 27, 1974

[21] Appl. No.: 536,918

Related U.S. Application Data

[63] Continuation-in-part of Ser. No. 460,145, April 11, 1974, abandoned, which is a continuation of Ser. No. 331,387, Feb. 12, 1973, abandoned.

[52] U.S. Cl. ..... 74/471 XY

[51] Int. Cl.[2] ..... G05G 9/00

[58] Field of Search ..... 74/471 XY, 110; 33/1 M; 214/1 BB, 1 BT

[56] References Cited

UNITED STATES PATENTS 3,680,401 8/1972 Shaw ..... 33/1 M 3,703,834 11/1972 Beezer ..... 74/110

FOREIGN PATENTS OR APPLICATIONS 1,184,829 3/1970 United Kingdom ..... 33/1 M

*Primary Examiner*—Benjamin W. Wyche
*Assistant Examiner*—Wesley S. Ratliff, Jr.
*Attorney, Agent, or Firm*—Wenderoth, Lind & Ponack

[57] ABSTRACT

An arm mechanism comprises a parallelogram link mechanism composed by an upper side link, a lower side link, a right side link and a left side link in a vertical plane, a load holding section provided at an end of an arm extended from the upper side link, and two sliding members provided at a coupling point of the right and lower side links and at an intersection of the right side link and a phantom line connecting the load holding section and the coupling point, respectively. The sliding members are moved in the horizontal and vertical direction to cause the load holding section to move in a vertical plane.

6 Claims, 7 Drawing Figures

ARM MECHANISM FOR MOVING HEAVY MATERIALS IN A TWO-DIMENSIONAL PLANE

CROSS REFERENCE TO RELATED APPLICATIONS

This application is a continuation-in-part of application Ser. No. 460,145, filed on Apr. 11, 1974, now abandoned, which is a continuation of application Ser. No. 331,387, filed on Feb. 12, 1973, now abandoned.

BACKGROUND OF THE INVENTION

This invention relates to heavy-material carrying apparatuses, and more particularly to arm mechanisms capable of moving heavy materials in a two-dimensional plane, for instance, a vertical plane.

It is known that apparatuses such as chain blocks and hoists are used for the movement of heavy materials or loads. However, such apparatuses are disadvantageous in that they cannot positively handle heavy materials in safety and are applicable to only some cargo work, and not to all cargo work, that is, their application is limited to some extent.

Therefore, a variety of heavy-material carrying apparatuses relatively simple in construction and convenient for the movement of heavy materials have been proposed. These apparatuses are, in general, of the small crane type, and are of the so-called dynamic type balance mechanism having an arm mechanism which is composed by links coupled one to another, so that when a load is held by a load holding section, such as a hook, of the apparatus, the section is free from the effect of gravity. Such arm mechanism comprises a parallelogram link mechanism formed by first, second, third and fourth links rotatably coupled to one another, sliding members respectively provided at the coupling point of the first and fourth links and at a free end of an arm extended from the third arm, guide members respectively provided for the sliding members, and a load holding section provided at a free end of an arm extended from the second link. By sliding the sliding members by a driving mechanism, balance of the arm mechanism is maintained while the load holding section is moved in a two-dimensional plane. The range, or area of this two-dimensional plane is limited by the combination of the links and the positions of the guide mechanisms because the arm mechanism employs a parallelogram link mechanism.

The conventional arm mechanism will be described in more detail with reference to FIG. 1. The apparatus comprises: a relatively flat parallelogram link mechanism A-B-C-D having four links 1, 2, 3 and 4 which are rotatably coupled to one another at coupling points A, B, C and D; an arm 2*a* forming one solid unit with the link 2; a load holding section F provided on the arm 2*a* on one side of the link mechanism; and guide mechanisms 5 and 6 provided on the other side of the same for sliding member provided on the coupling point D and a sliding member provided on a free end portion of an arm extended from the link 3.

In the apparatus thus organized, the load holding secton F is below the guide mechanism 5, and cannot be moved higher than the level of the guide mechanism 5. Therefore, in order to lift a load, it is necessary to install the apparatus higher than the level of the load by using, for instance, a tall support. Furthermore, since an end part of the link mechanism is above the load holding section at all times as is apparent from FIG. 1, when the apparatus is operated in a room having a ceiling or beams above, the end part of the link mechanism is liable to touch the ceiling or the beams, thus obstructing the operation of the apparatus. This trouble will be frequently caused especially when the load holding section is raised to its uppermost level.

SUMMARY OF THE INVENTION

Accordingly, it is an object of this invention to provide an arm mechanism for moving loads in a two-dimensional plane in which all of the above-described disadvantages accompanying the conventional arm mechanism are avoided.

More specifically, an object of the invention is to provide an arm mechanism for moving loads in a two-dimensional plane the load moving section, such as a hook, of which is movable above and below a driving section of a link mechanism.

Another object of the invention is to provide an arm mechanism for moving loads in a two-dimensional plane which is economical and superior in operational efficiency in the movement of loads.

A further object of the invention is to provide an arm mechanism for moving loads in a twol-dimensional plane which can lift a load without using a support such as a pillar.

The foregoing objects and other objects as well as the characteristic features of this invention will become more apparent from the following detailed description and the appended claims when read in conjunction with accompanying drawings, in which like parts are designated by like numerals or characters.

DETAILED DESCRIPTION OF THE INVENTION

Figure 1:
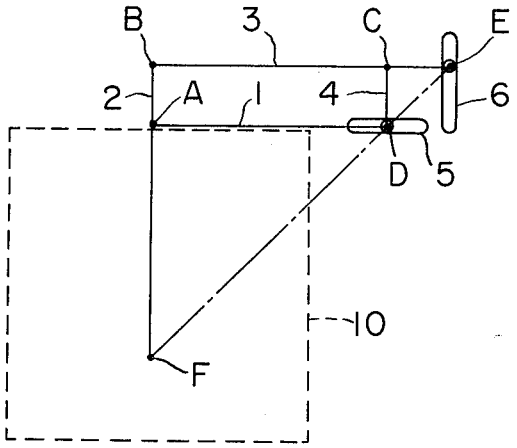
FIG. 1 is a schematic diagram illustrating the principle of a conventional arm mechanism for moving heavy materials in a two-dimensional plane.
Figure 2:
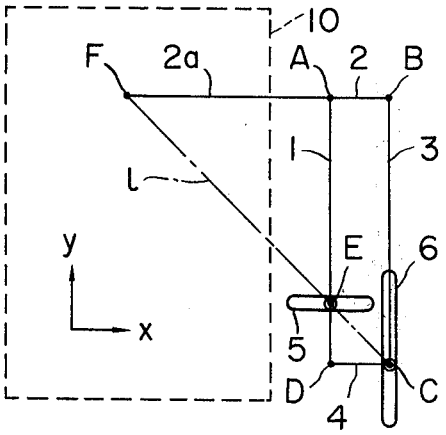
FIG. 2 is a schematic diagram illustrating one example of an arm mechanism for moving heavy materials in a two-dimensional plane according to this invention.

A first example of an arm mechanism for moving heavy materials in a two-dimensional plane according to this invention is shown in FIG. 2, and comprises a parallelogram link mechanism composed by first, second, third and fourth links 1, 2, 3 and 4 which correspond to four sides, that is, left, right and lower side, of the parallelogram link mechanism.

The first and third links 1 and 3 and the second and fourth links are arranged in the Y-axis and X-axis directions of a plane in which the parallelogram link mechanism lies, respectively. These links 1 through 4 are rotatably coupled to one another at coupling points A, B, C and D. An arm 2*a* extends from the second link 2, that is, the arm 2*a* and the second link 2 are formed into one solid unit. A load holding section F is fixedly provided at a free end of the arm 2*a*.

The arm mechanism further comprises sliding members E and C. The sliding member E is provided at an intersection point of the link 1 and a phantom line 1 indicated by the dot-dash line connecting the load holding section F and the coupling point C of the links 3 and 4, and slides in the X-axis direction along a guide mechanism 5. The sliding member C is provided at the coupling point C so as to moved in the Y-axis direction along a guide mechanism 6.

IN the arm mechanism thus organized, the parallelogram link mechanism is deformed by sliding the sliding members E and C along the respective guide mechanisms 5 and 6, and accordingly the load holding section F fixedly provided on the arm 2*a* is moved.

Since the parallelogram link mechanism, that is, a guadrilateral ABCD is a parallelogram, and the sliding member E is provided at an intersection point E of the first link 1 and the phantom line 1 connecting the load holding section F and the coupling point C as was described above, a triangle ECD is similar to a triangle EFA at all times wherever the sliding members C and E are positioned in the respective guide mechanisms 5 and 6. Accordingly, when the sliding members E and C have been moved along the guide mechanisms 5 and 6, respectively, the distances covered by the sliding members E and C are enlarged at the load holding section F. Sliding the sliding member C to the top of the guide mechanism 6, causes the load holding section F to move to its lowermost level; while sliding the sliding member C to the bottom of the guide member 6 causes the section F to move to its uppermost level. On the other hand, when the sliding member E is moved to the left end of the guide mechanism 5, the section F is moved to its leftmost position; while the sliding member E is moved to the right end of the guide mechanism 5, the section F is moved to its rightmost position. Thus, the maximum movement of load holding secton F draws a rectangular locus 10 indicated by the dotted line. That is, the loading holding section can move a load within the area of this locus (hereinafter referred to as a load movable area).

Figure 3:
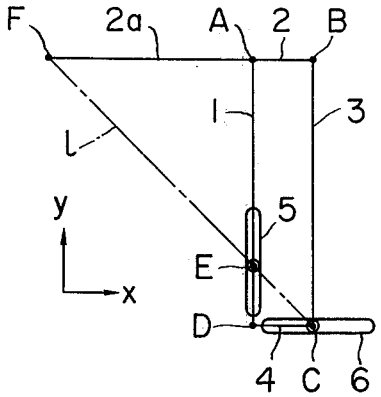
FIGS. 3 through 7 are also schematic diagrams illustrating other examples of the arm mechanism according to the invention.

A second example of the arm mechanism according to the invention is shown in FIG. 3, in which the guide mechanisms 5 and 6 shown in FIG. 2 are provided in the Y-axis direction and in the X-axis direction, respectively. The operation of the second example is similar to that of the first example described above.

Figure 4:
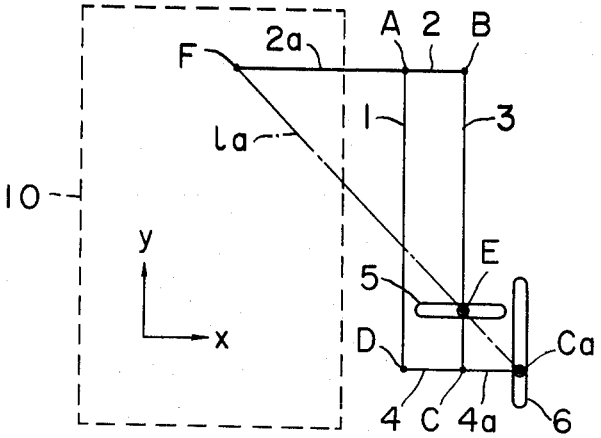

A third example of the arm mechanism according to the invention is shown in FIG. 4, which is obtained by modifying the first example (FIG. 2) in the following manner.

The sliding member C is removed from the coupling point C, and an arm 4*a* is extended rightward from the fourth link 4, that is, the arm 4a and the link 4 are formed into one solid unit. The sliding member E is provided at an intersection point of the third link and a dot-dash line 1*a* connecting the load hanging section F and a free end C*a* of the arm 4*a* in such a manner that the sliding member E slides along the horizontal guide mechanism 5. A new sliding member C*a* is provided at the free end C*a* so as to slide along the vertical guide mechanism 6.

Figure 5:
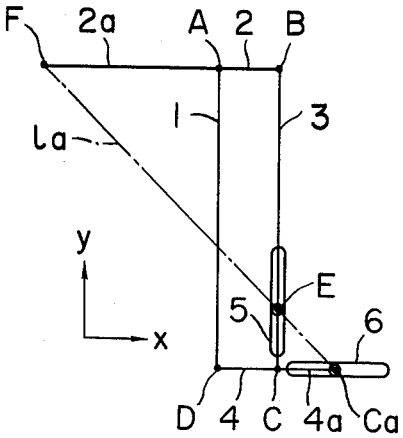

A fourth example of the arm mechanism according to the invention is shown in FIG. 5, which is obtained by arranging the guide mechanisms 5 and 6 shown in FIG. 4 in the directions of the Y-axis and X-axis, respectively.

In each of the examples shown in FIGS. 4 and 5, a load movable area 10 as indicated by the dotted line where the load hanging section F is movable is obtained.

In the arm mechanisms shown in FIGS. 4 and 5, since the load holding section F forms a certain angle with the arm 2*a* as was described before, the direction of the load holding section F is varied by sliding the sliding members E and C*a*.

Figure 6:
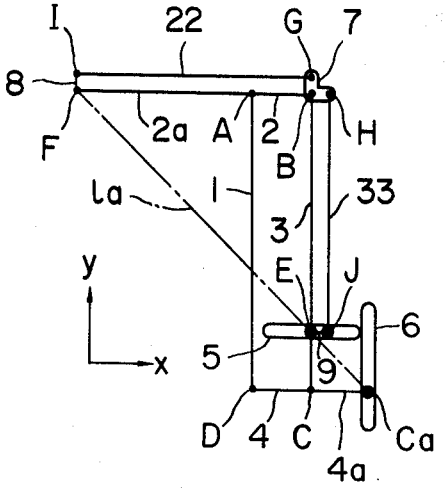
Figure 7:
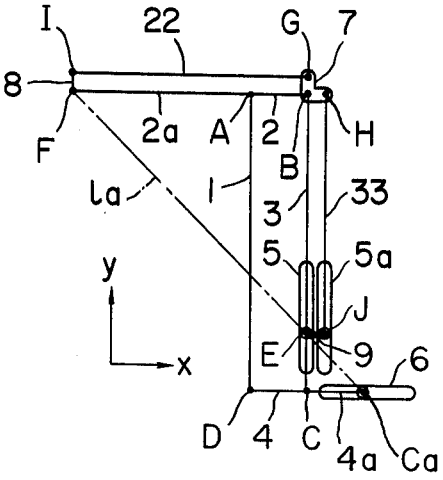

This disadvantage accompanying the arm mechanisms shown in FIGS. 4 and 5 is eliminated by fifth and sixth examples of the invention shown in FIGS. 6 and 7 respectively. That is, the fifth and sixth examples can maintain the direction of the load holding section F constant, for instance vertical, at all times no matter where the sliding members are positioned in the guide mechanisms.

Each of the arm mechanism shown in FIGS. 6 and 7 is provided with a right angle link member 7 rotatably coupled to the parallelogram link mechanism ABCD at the coupling point B, a first auxiliary link 22 rotatably coupled to the link member 7 at a coupling point G located at one end portion of the link member 7, and a second auxiliary link 33 rotatably coupled to the link member 7 at a coupling point located at the other end portion of the link member 7.

The length of the first auxiliary link 22 is equal to the sum of the length of the second link 2 and that of the arm 2*a*, while the length of the second auxiliary link 33 is equal to that of the third link 3.

The arm mechanism further comprises a link 8 which has the same length as the distance between the coupling points B and G and is rotatably coupled to the first auxiliary link 22 and the arm 2*a* at coupling points I and F, respectively, and a link 9 which has the same length as the distance between the coupling points B and H and is rotatably coupled to the third link 4 and the second auxiliary link 33 at coupling points E and J. As a result, guadrilaterals BFIG and BEJH form parallelograms, respectively.

The load holding section is provided on the link 8, and an additional sliding member J is provided at the coupling point J.

In the example shown in FIG. 6, both of the sliding members E and J slide along the guide mechanism 5.

In the example shown in FIG. 7, the sliding members E and J slide along the vertical guide mechanism 5 and an auxiliary guide mechanism provided in parallel to the guide mechanism 5, respectively.

In each of the examples shown in FIGS. 6 and 7, since the guadrilaterals ABCD, IFBG and BEJH are parallelograms as was described above, and the direction of the link 9 having the sliding members E and J is forcibly maintained unchanged regardless of the positions of the sliding members, the direction of the link 8 and accordingly that of the load holding section is maintained unchanged no matter where the sliding members are positioned in the respective guide mechanisms. A load movable area of the arm mechanism is similar to those of the examples previously described.

The sliding members E, C, C*a* and J employed in the various examples of the invention are for instance rollers or pinions which are provided in the vertical and horizontal guide mechanisms such as rails or racks and which are driven by a fluid pump or an electric motor.

The balancing of the arm mechanism itself is maintained by the application of a so-called dynamic balance method at all times whether or not the load holding section F holds a load. In other words, the effect of gravity imparted to the load holding section F is theoretically zeroed to maintain the arm mechanism balanced at all times. For this purpose, a driving source of the sliding members continuously operates, or springs are provided on the links and arms to utilize their repulsing powers.

Accordingly, in the case when a load is applied to the load holding section, that is, a heavy material to be moved is held by the load holding section, the weight of the load, which is decomposed in the directions of the X-axis and the Y-axis through the parallelogram link mechanism and the sliding memebers, is supported by the arm mechanism, and the load holding section is moved within the load movable area while the balance of the arm mechanism is maintained by the driving power of the driving source, such as an electric motor, provided for the sliding members.

As is apparent from the above description, the load holding section is above the guide mechanism according to this invention. Therefore, one of the disadvantages accompanying the conventional arm mechanisms that the arm mechanism must be positioned higher than loads to be lifted can be eliminated by the provision of the arm mechanism according to the invention. Furthermore, the fact that the load movable area can be provided above the guide members according to the invention facilitates the use of the arm mechanism in a room having a ceiling.

In addition, if the arm mechanism according to the invention is mounted on a base and rotating horizontally, it will become a cargo apparatus superior in operational efficiency.

I claim:

1. An arm mechanism for moving heavy materials in a two dimensional plane which comprises:

a. a parallelogram link mechanism lying in a two-dimensional plane including an X-axis and a Y-axis, said parallelogram link mechanism having right and left side links arranged in the direction of the Y-axis and upper and lower side links arranged in the direction of the X-axis and rotatably coupled to said right and left side links;

b. a load holding section provided at a free end of a first arm extended from said upper side link; and c. first and second sliding members, respectively provided at a coupling point of said right and lower side links and at an intersection point of said left side link and a phantom line connecting said load holding section to the coupling point of said right and lower side links, for sliding in the directions of the X-axis and Y-axis.

2. An arm mechanism as claimed in claim 1, in which said first and second sliding members are aranged so as to slide in the directions of said Y-axis and X-axis, respectively.

3. An arm mechanism for moving heavy materials in a two dimensional plane which comprises:

a. a parallelogram link mechanism lying in a two-dimensional plane including an X-axis and a Y-axis, said parallelogram link mechanism having right and left side links arranged in the direction of the Y-axis and upper and lower side links arranged in the direction of the X-axis and rotatably coupled to said right and left side links;

b. a load holding section provided at a free end of a first arm extended from said upper side link; and c. first and second sliding members, respectively provided at a free end of a second arm which is extended from said lower side link in the opposite direction to the first arm extended from said upper side link and at an intersection point of said right side link and a phantom line connecting said load holding section to the free end of said second arm, for sliding in the directions of said X-axis and Y-axis.

4. An arm mechanism as claimed in claim 3, in which said first and second sliding members are arranged so as to slide in the directions of said Y-axis and X-axis, respectively.

5. An arm mechanism as claimed in claim 3, which further comprises a right angle link member rotatably provided at a coupling point of said upper and right side links, and two auxiliary links rotatably coupled to said link member and arranged in parallel respectively to said upper side link and said right side link.

6. An arm mechanism as claimed in claim 4, which further comprises a right angle link member rotatably provided at a coupling point of said upper and right side links, and two auxiliary links rotatably coupled to said link member and arranged in parallel respectively to said upper side link and said right side link.

* * * * *